US008926051B2

(12) United States Patent
Martin et al.

(10) Patent No.: US 8,926,051 B2
(45) Date of Patent: Jan. 6, 2015

(54) HEATER CONTROLLER AND METHOD THEREOF

(75) Inventors: Eric T. Martin, Corvallis, OR (US); Mark H MacKenzie, Brush Prairie, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/119,495

(22) PCT Filed: Jul. 29, 2011

(86) PCT No.: PCT/US2011/045909

§ 371 (c)(1), (2), (4) Date: Nov. 22, 2013

(87) PCT Pub. No.: WO2013/019181

PCT Pub. Date: Feb. 7, 2013

(65) Prior Publication Data

US 2014/0098155 A1 Apr. 10, 2014

(51) Int. Cl.

| | |
|---|---|
| ***B41J 29/38*** | (2006.01) |
| ***B41J 29/00*** | (2006.01) |
| ***B41J 2/32*** | (2006.01) |
| ***B41J 2/365*** | (2006.01) |

(52) U.S. Cl.

CPC .. *B41J 29/00* (2013.01); *B41J 2/32* (2013.01); *B41J 2/365* (2013.01)

USPC ..... 347/17

(58) Field of Classification Search

CPC ..... B41J 2/32; B41J 2/04528; B41J 29/393

USPC ..... 347/17

See application file for complete search history.

(56) References Cited

U.S. PATENT DOCUMENTS

| | | | | |
|---|---|---|---|---|
| 6,213,595 | B1 | 4/2001 | Anagnostopoulos et al. | |
| 6,250,732 | B1 | 6/2001 | Coven | |
| 2006/0103695 | A1 * | 5/2006 | Young et al. | 347/58 |
| 2007/0229568 | A1 * | 10/2007 | Matsumoto | 347/17 |
| 2008/0143789 | A1 | 6/2008 | Takeuchi et al. | |
| 2010/0165053 | A1 | 7/2010 | Bergstedt et al. | |

FOREIGN PATENT DOCUMENTS

| | | |
|---|---|---|
| JP | 03-227643 | 10/1991 |
| JP | 05-024199 | 2/1993 |
| JP | 8039811 | 8/1994 |
| JP | 2001-225463 | 8/2001 |
| JP | 2002-347223 | 12/2002 |

* cited by examiner

*Primary Examiner* — Jannelle M Lebron

(74) *Attorney, Agent, or Firm* — Hewlett-Packard Patent Department; Angela M. Cox

(57) ABSTRACT

A heater controller to maintain a uniform temperature of a printhead is provided herein. The heater controller monitors the temperature of the printhead and controls the heating of the printhead. The heater controller enables at least two of a plurality of warming groups based on warming power requirements of the printhead. The heater controller alternates activation of the at least two of the plurality of warming groups by rotating each of the at least two of the plurality of warming groups between an on mode and an off mode to uniformly distribute heating power to the printhead.

20 Claims, 5 Drawing Sheets

HEATER CONTROLLER AND METHOD THEREOF

BACKGROUND

Inkjet printheads are commonly used for printing. Printheads are maintained at a constant temperature to achieve consistent drop characteristics and obtain high print quality. Heaters are used to maintain printheads at a constant temperature.

BRIEF DESCRIPTION OF THE DRAWINGS

Non-limiting examples of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures:

DETAILED DESCRIPTION

In the following detailed description, reference is made to the accompanying drawings which form a part hereof, and in which is depicted by way of illustration specific examples in which the present disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims.

Printheads are maintained at a constant temperature by monitoring the temperature of the printhead and using heaters to maintain the constant temperature. To heat printheads one or all of the heaters are turned on, depending on the amount of heat required to maintain the constant temperature. For example, a printhead may have four heaters and require a heating power level (or warming power level) of fifty percent to keep the printhead at the constant temperature. To obtain fifty percent heating power level, one option is to set the four heaters at a fifty percent duty cycle; however, using all four heaters at the same time could have high current requirements. Another option is to turn on one-half of the heaters (i.e., two heaters). Using one-half of the heaters to maintain the constant temperature on the printhead can cause localized high-temperature zones near the heaters that are turned on. The localized high-temperature zones cause temperature gradients or non-uniform temperature distribution on the printhead.

A heater controller to maintain a uniform temperature of a printhead is provided herein. In examples, the heater controller selectively enables at least two of the plurality of warming groups and activates the at least two of the plurality of warming groups enabled in an alternating manner. The activation includes rotation of each of the at least two of the plurality of warming groups between an on mode and an off mode. The heater controller maintains the printhead at a uniform temperature through the heating of each of the enabled at least two of the plurality of warming groups on an alternating or rotational basis, which reduces non-uniform temperature distribution across the printhead.

Figure 1:
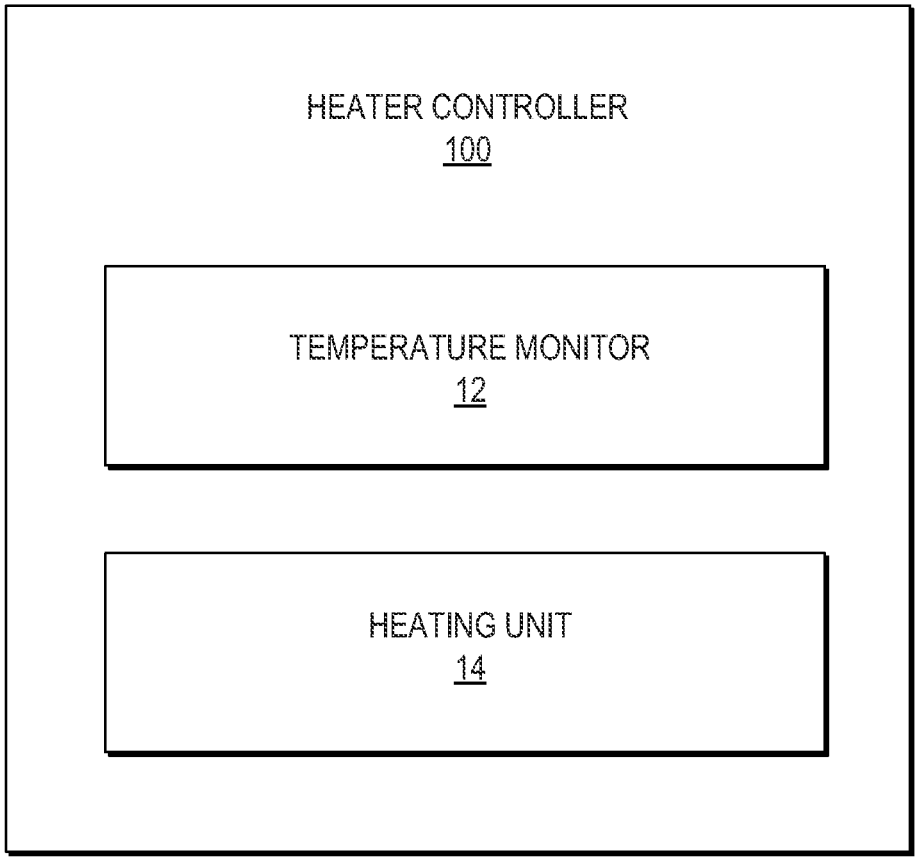
FIG. 1 illustrates a block diagram of a heater controller according to an example.

FIG. 1 illustrates a block diagram of a heater controller 100 according to an example. The heater controller is useable with a set of heaters to maintain a uniform temperature of a printhead. The heater controller 100 includes a temperature monitor 12 and a heating unit 14. The temperature monitor 12 monitors the temperature of the printhead. For example, the temperature monitor 12 receives the temperature from a temperature monitoring circuit that performs the temperature monitoring on all or a portion of a printhead. The temperature monitor 12 is connected to the temperature monitoring circuit and/or includes the temperature monitoring circuit therein.

The heating unit 14 controls heating of the printhead with a plurality of warming groups. Each of the plurality of warming groups include at least one heater from the set of heaters and the plurality of warming groups may be determined by the heater controller, using for example, the heating unit 14. The heating unit 14 enables at least two of the plurality of warming groups based on the warming power requirements of the printhead. The heating unit 12 receives, for example, direct current (DC) signals to enable the warming groups. The at least two of the plurality of warming groups may include all of the warming groups being enabled or only a portion of the warming groups being enabled. The heating unit 14 also alternates activation of the at least two of the plurality of warming groups by rotating each of the at least two of the plurality of warming groups between an on mode and an off mode to uniformly distribute heating power to the printhead. For example, at a first time, one of the at least two of the plurality of warming groups is in the on mode and the other of the at least two of the plurality of warming groups is in the off mode. At a second time, the one of the at least two of the plurality of warming groups is in the off mode and the other of the at least two of the plurality of warming groups is in the on mode.

The heater controller 100 receives timing signals from a clock. For example, the heating unit 14 is connected to and/or includes the clock. The clock provides timing signals that indicate the first time, the second time, and subsequent times. The clock may work in combination with a group control. The group control is included in the heating unit 14 and/or attached to the heating unit 14 such that the group control switches the activation of each of the at least two of the plurality of warming groups between the on mode and the off mode. The group control may use the timing signals to switch the activation of the warming groups.

The heating unit 14 activates the at least two of the plurality of warming groups to a warming power level. The heating unit 14 receives a variety of warming power levels (or power levels) from a warming power level control depending on the number of warming groups, such that there is one warming power level for each warming group and a warming power level of off. For example, when there are two warming groups, the number of warming power levels include high when both warming groups are on, low when one warming group is on, and off when both warming groups are not on. Similarly, when there are three warming groups, there are four warming power levels, high when all four warming groups are turned on, medium when two of the three warming groups are turned on, low when one of the three warming groups are turned on, and off when none of the warming groups are turned on.

The warming power level that the at least two warming groups are activated (or set) to are based on the warming power requirements of the printhead. For example, when it is determined that the printhead should be heated at a low power level to maintain the uniform temperature, then the at least two of the plurality of warming groups are set to a low power level. Conversely, when it is determined that the printhead should be heated at a high power level due to, for example, the temperature of the printhead, conditions of the printhead, the media, and/or the environment surrounding the printhead, then the warming groups are set to a high power level. The settings of, for example, high, medium, low, and/or off may be used in combination with the dock to maintain the uniform temperature of the printhead over a period of time. The power level may vary in predetermined patterns using the clock and the group control, for example, the groupings are rotated and/or the power level settings are changed or alternated to maintain the printhead at a target or predetermined temperature.

Figure 2:
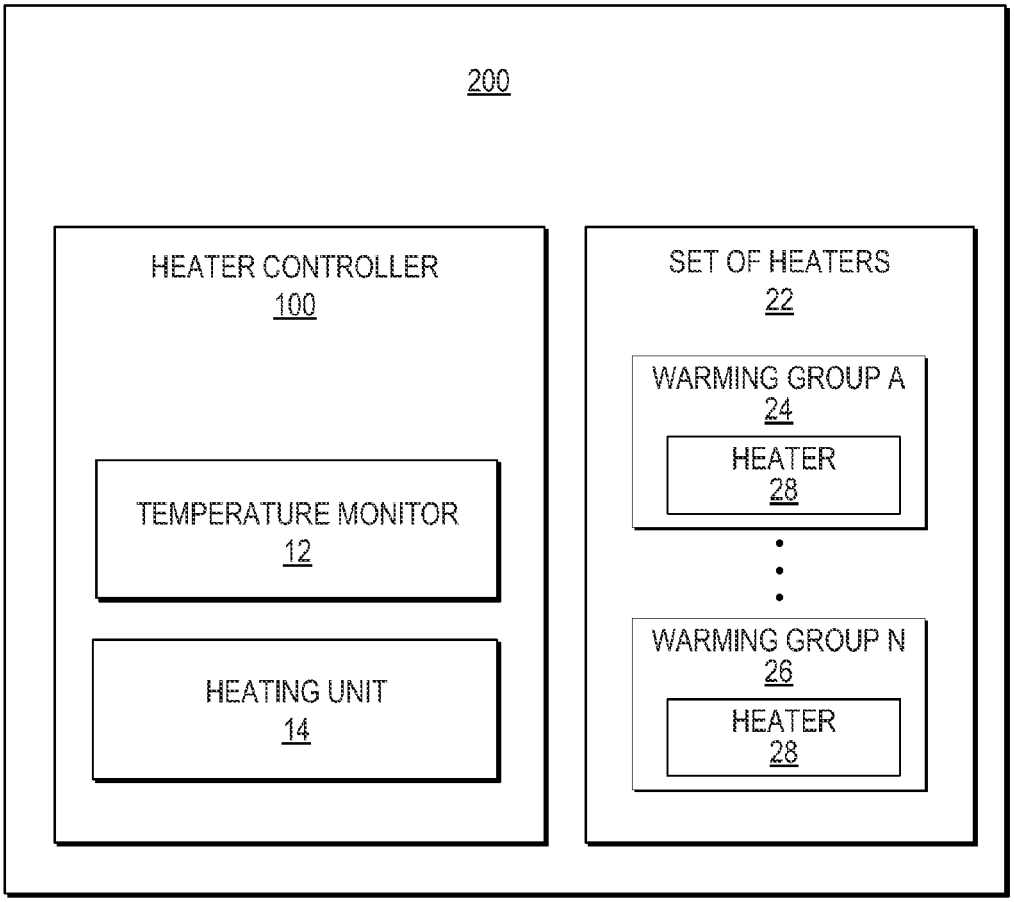
FIG. 2 illustrates a block diagram of a system useable with a printhead according to an example.

FIG. 2 illustrates a block diagram of a system 200 useable with a printhead according to an example. The system 200 includes a set of heaters 22 and a heater controller 100. For example, the set of heaters 22 may be the firing resistors of an inkjet printhead that may be used to fire ink using firing pulses and heat the printhead using warming pulses. The warming pulses provide the firing resistors with enough energy to warm the printhead, but not enough energy to cause ejections of fluid. Moreover, the set of heaters 22 are warming resistors dedicated only to warming to provide trickle heating by dissipating low levels of direct current (DC) power, such that the warming resistors are turned on and/or off based on the temperature monitoring circuitry.

The set of heaters 22 are divided into a plurality of warming groups. The plurality of warming groups are illustrated as at least two warming groups, warming group A 24 through warming group N 26, with N representing any number of warming groups greater than and/or equal to two. Each warming group 24, 26 includes at least one heater 28, but the number of heaters 28 may vary depending on the printhead. The spatial configuration of the warming groups may be distributed evenly across the entire printhead and/or co-located (or grouped) in regions of the printhead. When the warming groups are evenly distributed across the entire printhead, an even warming power may be distributed across the entire printhead to maintain a constant temperature throughout the printhead. When the warming groups are co-located, a plurality of the warming groups may be positioned closely to one another. The co-located warming groups are used, for example, when a structure on the printhead acts as a heat sink, such as ink, adhesives, and/or mechanical connections between the printhead silicon and the printhead body. The co-located warming groups maintain uniform temperatures across the printhead by distributing a greater warming power to the area surrounding the effective heat sink, which compensates for the higher rate of dissipation of the warming power in the heat sink regions.

The heater controller 100 is connected to the heaters 28 to maintain a uniform temperature on the printhead using the plurality of warming groups 24, 26. The heater controller 100 includes a temperature monitor 12 to monitor the temperature of the printhead and a heating unit 14 to control the heating of the printhead by controlling the dissipation of power to the heaters 28. The heating unit 14 enables at least two of the plurality of warming groups using, for example, direct current (DC) signals. The at least two of the plurality of warming groups are enabled based on the warming power requirements of the printhead. The warming power requirements may be determined by, for example, the temperature of the printhead, the printing conditions, the media, and/or the environment surrounding the printhead.

The heating unit 14 alternates activation of each of the at least two of the plurality of warming groups to a warming power level. Each of the at least two of the plurality of warming groups are rotated between an on mode and an off mode to uniformly distribute heating power to the printhead. For example, at a first time, one of the at least two of the plurality of warming groups is in the on mode and the other of the at least two of the plurality of warming groups is in the off mode, and at a second time, the one of the at least two of the plurality of warming groups is in the off mode and the other of the at least two of the plurality of warming groups is in an on mode. The use of the one and the other of the at least two of the plurality of warming groups does not limit the disclosure to only two warming groups, but illustrates the interaction between any two or more warming groups. For example, when there are three or more warming groups, each warming group is rotated between an on mode and an off mode. Furthermore, more than one of the warming groups may be on at the same time, such as a group of four warming groups, A, B, C, and D, may be rotated as follows: at a first time warming groups A, B, and C are on; at a second time warming groups B, C, and are on; at a third time warming groups A, C, and D are on; and at a fourth time warming groups A, B, and D are on. The rotation reduces localized high-temperature zones by alternating activation of the enabled warming groups between an on mode and an off mode. Moreover, the rotation allows the enabled warming groups to spatially heat a larger area of the printhead, for example the entire printhead, while reducing the localized high-temperature zones.

Figure 3:
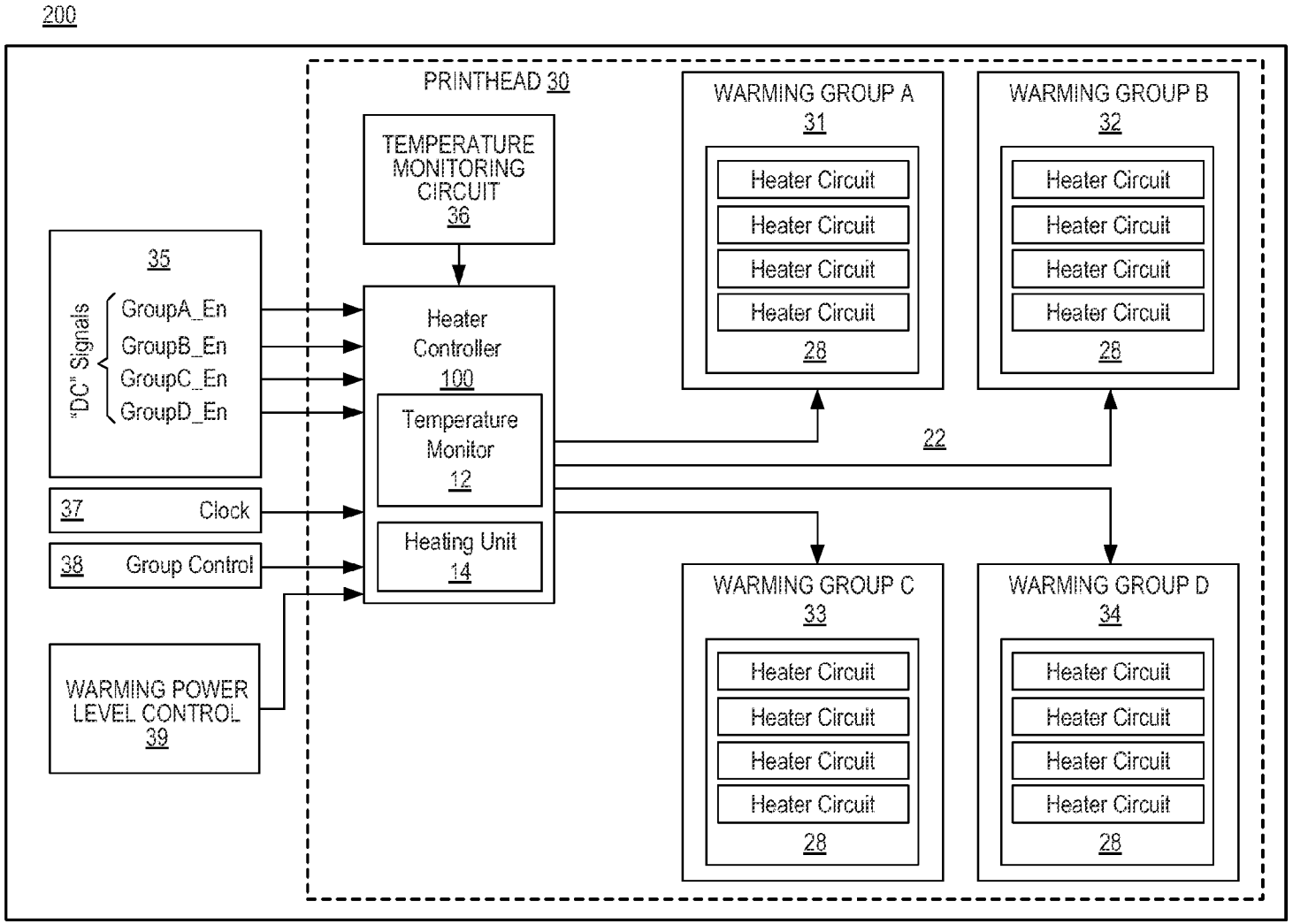
FIGS. 3-4 illustrate schematic views of the system of FIG. 2 according to examples.
Figure 4:
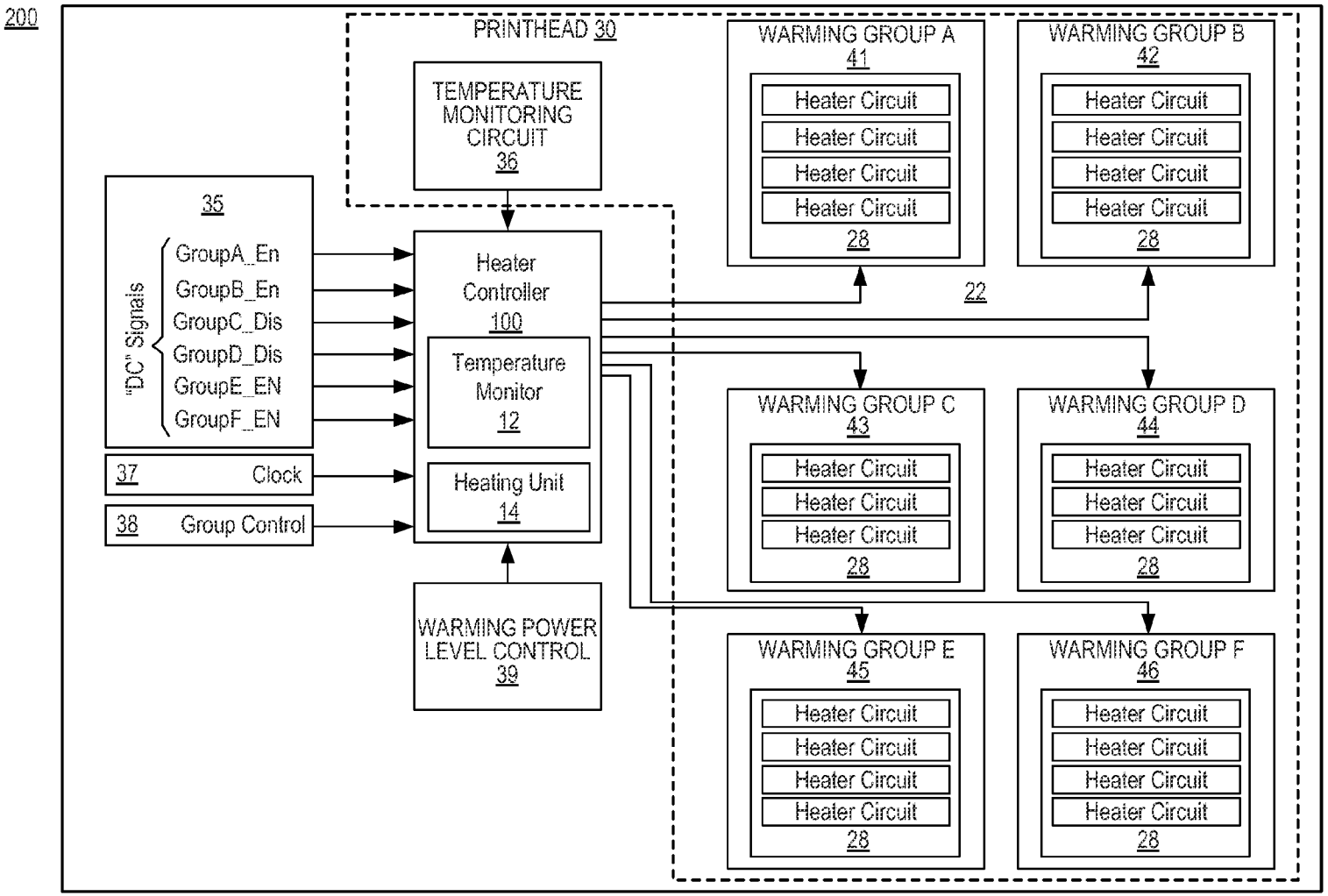

FIGS. 3-4 illustrate perspective views of the system 200 of FIG. 2 according to examples. In FIG. 3, the heater controller 100 and the set of heaters 22 are illustrated as integrated into the printhead 30. In FIG. 4, the heater controller 100 is not integrated into the printhead, but connected to the printhead 30. Referring to FIG. 34, the heater controller 100 is connected to the set of heaters 22. The set of heaters 22 are illustrated as being divided into four warming groups A 31, B 32, C 33, and D 34 in FIG. 3 and six warming groups A 41, B 42, C 43, D 44, E 45, and F 46 in FIG. 4.

Each of the warming groups include at least one heater 28 and may include varying numbers of heaters 28. In FIG. 3, each warming group has the same number of heaters or heater circuits, i.e., four heater circuits. In FIG. 4, the number of heaters or heater circuits in the warming groups varies between the warming groups. For example, warming groups A 41, B 42, E 45, and F 46 each have four heater circuits and warming groups C 43 and D 44 each have three heater circuits. The heaters 28 of the warming groups are enabled by providing, for example, a direct current signal 35 for each of the warming groups to the heater controller 100. The direct current signals 35 enable at least two of the warming groups, including all of the warming groups (FIG. 3) enabled and/or any combination between at least two of the warming groups enabled and all of the warming groups enabled. For example, FIG. 4 illustrates four of the six warming groups being enabled.

Referring to FIG. 3, the four warming groups each include one-fourth or twenty-five percent of the total heaters on the printhead 30. Using the four warming groups A 31, B 32, C 33, and 34, as an example, a twenty-five percent power level or heating level is obtained by enabling the heaters 28 on all of the four warming groups A 31, B 32, C 33, and D 34 and rotating the activation of the heaters 28 (e.g., heater circuits) in each of the warming groups A 31, B 32, C 33, and t 34 one by one. Referring to FIG. 4, four of the six warming groups are enabled and a power level or heating level of two-thirds is obtained when all four enabled heaters 28 are activated. This allows for two-Thirds of the heaters to be activated together to obtain a power level of two-thirds and/or on a rotational basis to reduce the power level to, for example, one-half, one-third, or one-sixth. A reason for enabling warming groups A 41, B, 42, E 45, and F 46, as illustrated in FIG. 4, is to avoid heating and/or overheating specific areas of the printhead. For example, the center of the printhead may reach a higher temperature when the printhead 30 is in a printing mode. Hence, by enabling and activating only a portion of the warming groups the heaters warms the specified warming groups (i.e., warming groups on the outer portions of the printhead 30), while reducing localized high-temperature zones.

Referring to FIGS. 3-4, the system 200 may further include a temperature monitoring circuit 36 on the printhead 30 to monitor the temperature of the printhead 30. Each printhead 30 includes at least one temperature monitoring circuit 36, but may include multiple temperature monitoring circuits 36 depending on the printhead and spatial locations of the warming groups. The temperature monitoring circuit 36 provides information related to the temperature of the printhead 30 to the temperature monitor 12. For example, the temperature monitoring circuit 36 may include an AND gate that allows the heater controller to warm the printhead when the temperature monitoring circuit 36 indicates that the printhead 30 is below a target or predetermined temperature. The temperature monitor 12 receives the temperature of the printhead 30 from the temperature monitoring circuit 36 and communicates with the heating unit 14, which then controls the heating of the printhead 30.

A combination of a dock 37, a group control 38, and/or a warming power level control 39 may be used by the heater controller 100 to assist with maintaining the uniform temperature, as illustrated in FIGS. 3-4. The heater controller 100 and/or heating unit 14 receive timing signals from the clock 37. The dock indicates, for example, the first time, the second time, and subsequent times. The heater controller 100 and/or heating unit 14 receives switching signals from the group control 38 to switch the activation of each of the at least two of the plurality of warming groups between the on mode and the off mode. The group control 38 may provide a variety of activation patterns to evenly distribute the heat. For example, in FIGS. 3-4, four warming groups are enabled; therefore, any combination of one, two, three, and/or four of the warming groups may be activated to the on mode and/or off mode on a timing schedule that include for example, a first time, second time, third time, etcetera. Moreover, the combinations may change the number of warming groups that are activated at each time, as controlled by the group control 38. The clock 37 in combination with the group control 38 temporally and spatially distributes warming power by cycling or rotating through the enabled warming groups using the timing signals and the switching signals.

The warming power level control 39 assists with uniformly distributing the heating power by activating the at least two of the plurality of warming groups to a warming power level of, for example, at least one of high, low, and off when two warming groups are activated. The warming power levels are based on the warming power requirements of the printhead 30. When the temperature of the printhead 30 is, for example, low compared to a target or predetermined temperature, the warming power level may be set to high. However, when the temperature of the printhead 30 is only slightly lower than the target or predetermined temperature, the warming power level may be set to low to heat and/or maintain the target or predetermined temperature of the printhead 30. Referring to FIG. 3, twenty-five percent of the warming power level may be achieved when the warming power level control 39 sets the warming power level to high and activates and rotates between the activated warming groups one at a time. The twenty-five percent of the warming power level may also be achieved by setting the warming power level to one-half of high power, i.e., low level, and activating two of the warming groups at one time and rotating between the four warming groups two at a time.

Figure 5:
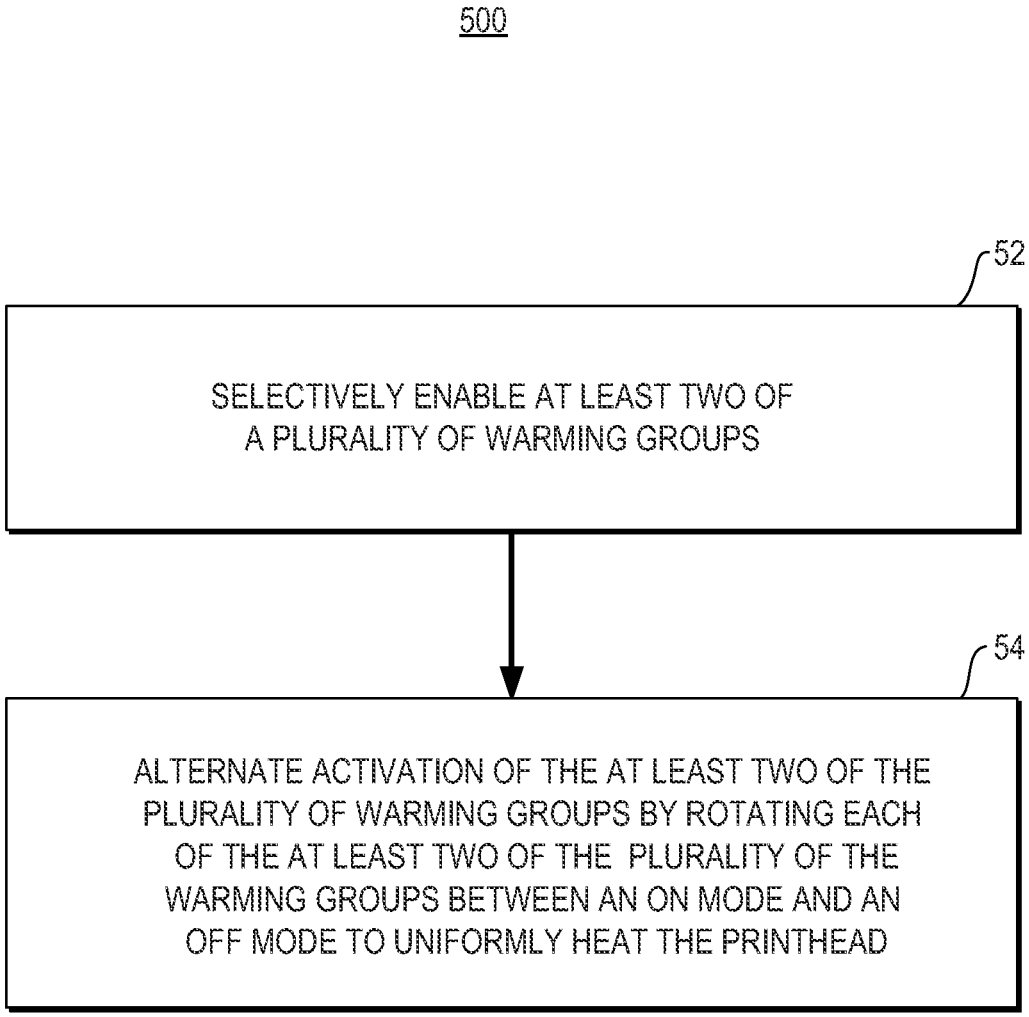
FIG. 5 illustrates a flow chart of a method to maintain a uniform temperature of a printhead according to an example.

FIG. 5 illustrates a flow chart 500 of a method to maintain a uniform temperature of a printhead according to an example. In block 52, at least two of a plurality of warming groups on the printhead are selectively enabled. The plurality of warming groups are formed by dividing the control of the set of heaters on the printhead into a plurality of warming groups. The division may be controlled by, for example, a heater controller. The division of the plurality of warming groups and/or the selection of the at least two warming groups is based on the warming power requirements of the printhead. The printhead temperature may be a factor in the warming power requirements and may be monitored using, for example, a temperature monitoring circuit. The at least two of the plurality of warming groups are enabled using, for example, direct current signals.

The at least two of the plurality of warming groups are activated in an alternating manner in block 54 by rotating each of the at least two of the plurality of warming groups between an on mode and an off mode to uniformly distribute heating power to the printhead. For example, at a first time, one of the at least two of the plurality of warming groups is in an on mode and the other of the at least two of the plurality of warming groups is in an off mode. At a second time, the one of the at least two of the plurality of warming groups is in an off mode and the other of the at least two of the plurality of warming groups is in the on mode. The activation of the at least two of the plurality of warming groups are alternated by rotating each of the at least two of the plurality of warming groups between an on mode and an off mode using, for example a clock.

The activation of the warming groups may be synchronized with printing and/or asynchronous with printing, depending on the configuration of the printhead and/or heater controller. The activation of the at least two of the plurality of warming groups is synchronized with printing when the printhead is in a printing mode and activation of the warming groups maintains the ink and/or printhead at the target or predetermined temperature. When the printhead is not in a printing mode, the activation of the warming groups is asynchronous and may, for example, occur prior to starting a print job, such as to heat the ink and/or printhead to a target or predetermined temperature prior to initiating the printing mode. Moreover, the at least two of the plurality of warming groups may be activated to a warming power level of at least one of high, low, and off when two warming groups are activated using, for example a warming power level control, as described above.

The present disclosure has been described using non-limiting detailed descriptions of examples thereof and is not intended to limit the scope of the present disclosure. It should be understood that features and/or operations described with respect to one example may be used with other examples and that not all examples of the present disclosure have all of the features and/or operations illustrated in a particular figure or described with respect to one of the examples. Variations of examples described will occur to persons of the art. Furthermore, the terms "comprise," "include," "have" and their conjugates, shall mean, when used in the present disclosure and/or claims, "including but not necessarily limited to."

It is noted that some of the above described examples may include structure, acts or details of structures and acts that may not be essential to the present disclosure and are intended to be exemplary. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. A method to maintain a uniform temperature of a printhead, the method comprising:

selectively enabling at least two of a plurality of warming groups on the printhead, each of the plurality of warming groups include at least one heater; and alternating activation of the at least two of the plurality of warming groups by rotating each of the at least two of the plurality of warming groups between an on mode and an off mode to uniformly distribute heating power to the printhead, wherein at least some of the plurality of warming groups are co-located in a region of the printhead comprising high rate of heat dissipation, such that at a first time, one of the at least two of the plurality of warming groups is in the on mode and the other of the at least two of the plurality of warming groups is in the off mode, and at a second time, the one of the at least two of the plurality of warming groups is in the off mode and the other of the at least two of the plurality of warming groups is in the on mode.

2. The method of claim 1, further comprising activating the at least two of the plurality of warming groups to a warming power level of at least one of high, low, and off.

3. The method of claim 1, further comprising alternating the activation of the at least two of the plurality of warming groups by rotating each of the at least two of the plurality of warming groups between the on mode and the off mode using a clock.

4. The method of claim 1, further comprising monitoring the temperature of the printhead using a temperature monitoring circuit.

5. The method of claim 1, further comprising selectively enabling the at least two of the plurality of warming groups based on warming power requirements of the printhead.

6. The method of claim 1, further comprising selectively enabling at least two of a plurality of warming groups on the printhead wherein the number of heaters in each warming group varies.

7. The method of claim 1, further comprising distributing greater warming power to the region of the printhead comprising high rate of heat dissipation.

8. A heater controller useable with a set of heaters to maintain a uniform temperature of a printhead, the heater controller comprising:

a temperature monitor to monitor the temperature of the printhead; and a heating unit to control heating of the printhead with a plurality of warming groups, each of the plurality of warming groups including at least one heater from the set of heaters, the heating unit:

enables at least two of a plurality of warming groups based on warming power requirements of the printhead; and alternates activation of the at least two of the plurality of warming groups by rotating each of the at least two of the plurality of warming groups between an on mode and an off mode to uniformly distribute heating power to the printhead, wherein at least some of the plurality of warming groups are co-located in a region of the printhead comprising high rate of heat dissipation, wherein at a first time, one of the at least two of the plurality of warming groups is in the on mode and the other of the at least two of the plurality of warming groups is in the off mode, and at a second time, the one of the at least two of the plurality of warming groups is in the off mode and the other of the at least two of the plurality of warming groups is in the on mode.

9. The heater controller of claim 8, wherein the temperature monitor receives the temperature of the printhead from a temperature monitoring circuit.

10. The heater controller of claim 8, wherein the heating unit receives:

timing signals from a clock to indicate the first time and the second time; and input from a group control to switch each of the at least two of the plurality of warming groups between the on mode and the off mode using the timing signals.

11. The heater controller of claim 8, wherein the heating unit receives a warming power level from a warming power level control to activate the at least two of the plurality of warming groups to the warming power level of at least one of high, low, and off based on warming power requirements of the printhead.

12. The heater controller of claim 8, wherein the heating unit is to enable at least two of a plurality of warming groups wherein the number of heaters in each warming group varies.

13. The heater controller of claim 8, wherein the heating unit is to distribute greater warming power to the region of the printhead comprising high rate of heat dissipation.

14. A system useable with a printhead comprising:

a set of heaters divided into a plurality of warming groups, each warming group including at least one heater, wherein at least some of the plurality of warming groups are co-located in a region of the printhead comprising high rate of heat dissipation; and a heater controller to maintain a uniform temperature on the printhead using the plurality of warming groups, the heater controller including:

a temperature monitor to monitor the temperature of the printhead; and a heating unit to:

enable at least two of the plurality of warming groups based on warming power requirements of the printhead; and alternate activation of each of the at least two of the plurality of warming groups to a warming power level, wherein each of the at least two of the plurality of warming groups are rotated between an on mode and an off mode to uniformly distribute heating power to the printhead, wherein at a first time, one of the at least two of the plurality of warming groups is in the on mode and the other of the at least two of the plurality of warming groups is in the off mode, and at a second time, the one of the at least two of the plurality of warming groups is in the off mode and the other of the at least two of the plurality of warming groups is in an on mode.

15. The system of claim 14, wherein the temperature monitor comprises a temperature monitoring circuit.

16. The system of claim 14, further comprising a clock to indicate the first time and the second time.

17. The system of claim 14, further comprising a group control to switch each of the at least two of the plurality of warming groups between the on mode and the off mode.

18. The system of claim 14, further comprising a warming power level control to activate the at least two of the plurality of warming groups to a warming power level of at least one of high, low, and off based on warming power requirements of the printhead.

19. The system of claim 14, wherein the heating unit enables at least two of a plurality of warming groups wherein the number of heaters in each warming group varies.

20. The system of claim 14, wherein the heating unit distributes greater warming power to the region of the printhead comprising high rate of heat dissipation.

* * * * *